US005900174A

United States Patent [19]

Scott

[11] Patent Number: 5,900,174

[45] Date of Patent: May 4, 1999

[54] COOKING UTENSIL DETECTION METHOD

[75] Inventor: Richard Charles Scott, Stourport-on-Severn, United Kingdom

[73] Assignee: Ceramaspeed Limited

[21] Appl. No.: 08/972,109

[22] Filed: Nov. 17, 1997

[30] Foreign Application Priority Data

Dec. 19, 1996 [GB] United Kingdom ..... 9626355

[51] Int. Cl.[6] ..... H05B 3/68; H05B 1/02; H05B 6/12

[52] U.S. Cl. ..... 219/447.1; 219/518; 219/626

[58] Field of Search ..... 219/446.1, 447.1, 219/460.1, 461.1, 465.1, 518, 620, 621, 626

[56] References Cited

U.S. PATENT DOCUMENTS

| | | | |
|---|---|---|---|
| 4,129,767 | 12/1978 | Amagami et al. | 219/626 |
| 4,319,109 | 3/1982 | Bowles | 219/626 |
| 4,499,368 | 2/1985 | Payne | 219/447.1 |
| 5,001,328 | 3/1991 | Schreder et al. | 219/518 |
| 5,223,697 | 6/1993 | Wilde et al. . | |
| 5,243,172 | 9/1993 | Hazen et al. . | |
| 5,296,682 | 3/1994 | Wittauer et al. | 219/447.1 |
| 5,296,684 | 3/1994 | Essig et al. . | |
| 5,424,512 | 6/1995 | Turetta et al. | 219/447.1 |

FOREIGN PATENT DOCUMENTS

| | | |
|---|---|---|
| 442275 | 8/1991 | European Pat. Off. . |
| 469189 | 2/1992 | European Pat. Off. . |
| 490289 | 6/1992 | European Pat. Off. . |
| 3733108 | 2/1989 | Germany . |

OTHER PUBLICATIONS

European Search Report Jun. 30, 1998 EP 97309743.

UK Patent Office Search Report Mar. 10, 1997 GB 9026355.3.

*Primary Examiner*—Teresa Walberg
*Assistant Examiner*—Sam Paik
*Attorney, Agent, or Firm*—Ira S Dorman

[57] ABSTRACT

A method is described of processing an electrical signal output from a sensor coil located in an electric heater for use under a cook top in a cooking appliance. The sensor coil is employed to operate a switch to switch on and off a heating element in the heater in accordance with placement and removal of a cooking utensil on and from the cook top. The sensor coil is arranged in the heater within magnetic influence of the electrical heating element, the heating element comprising a material which is ferromagnetic below and substantially non-ferromagnetic above a predetermined temperature within an operating temperature range of the heater. The occurrence of an increase in output signal level from the sensor coil is detected and closure of the switch is effected. Subsequently, the occurrence of a decrease in output signal level from the sensor coil is detected and opening of the switch is effected. The switch is opened for a predetermined period and closure of the switch means is subsequently effected unless within the predetermined time period a further decrease in output signal level, consecutive with the previous decrease in output signal level, is detected.

17 Claims, 5 Drawing Sheets

COOKING UTENSIL DETECTION METHOD

FIELD OF THE INVENTION

This invention relates to a signal processing method for use with cooking utensil detection systems for electric heaters in glass-ceramic top cooking appliances and particularly, but not exclusively, for radiant electric heaters.

DESCRIPTION OF PRIOR ART

Such detection systems are known, for example from European Patent Publication No. 0 442 275, European Patent Publication No. 0 469 189 and European Patent Publication No. 0 490 289, which operate using inductive techniques and in which a sensor coil is located inside a heater and connected to some form of oscillatory circuit. When a metal cooking utensil, such as a pot or pan, is placed on the glass-ceramic cooking surface, overlying the heater, the inductive coupling effect between the utensil and the sensor coil results in a change in output signal from the sensor coil which is processed and used to switch on the heater. A further change in output signal from the sensor coil, when the cooking utensil is subsequently removed from the glass-ceramic cooking surface, is used to effect automatic switching off of the heater.

The change in output signal from the sensor coil when the cooking utensil is placed or removed is small, and becomes smaller the greater the distance between the cooking utensil and the sensor coil. It is possible for the change in output signal resulting from placement or removal of a cooking utensil to be of similar magnitude to changes resulting from other effects such as ambient temperature drift. Since the changes resulting from these other effects generally occur more slowly than those resulting from placement or removal of a cooking utensil, this problem has been overcome by monitoring the rate of change of the output signals from the sensor coil.

It would be convenient to provide the sensor coil beneath the heating element or elements in the heater and particularly to embed the coil in a layer of thermal and electrical insulation material which is well known to be provided beneath the heating element. Such insulation material in well known form comprises microporous insulation material provided by compacting powdered material into a support dish, such as of metal. One or more heating elements of well known form, such as wire coils, metal ribbons or halogen lamps are supported adjacent to, or on, or partially embedded in, the surface of the layer of insulation material.

When this location is selected for the sensor coil, in addition to the problem of output signal strength already referred to as a result of the relatively large distance between a cooking utensil and the sensor coil, a further problem arises on account of the nature of the material used for the heating element or elements. The most commonly used material for heating elements of coil or ribbon form is an iron-chromium-aluminium alloy. This material is ferromagnetic at room temperature, but when used as an electrical heating element and heated up to its operating temperature it becomes non-ferromagnetic. The transition from being ferromagnetic to becoming non-ferromagnetic occurs at the well known Curie temperature of the material. Furthermore, the transition occurs rapidly.

As a consequence of this, the output of the sensor coil changes when the heating element passes through its Curie temperature during heating and cooling. The amplitude and rate of the Curie temperature-related output changes of the sensor coil may be such that they are not distinguished by the processing circuitry from output changes resulting from placement or removal of a cooking utensil.

OBJECT OF THE INVENTION

It is an object of the present invention to overcome or minimise this problem.

SUMMARY OF THE INVENTION

According to the present invention there is provided a method of processing an electrical signal output from a sensor coil located in an electric heater for use under a cook top in a cooking appliance and operating a switch means to switch on and off a heating element in the heater in accordance with placement and removal of a cooking utensil on and from the cook top respectively, the sensor coil being arranged in the heater within magnetic influence of the electrical heating element, the heating element comprising a material which is ferromagnetic below and substantially non-ferromagnetic above a predetermined temperature within an operating temperature range of the heater, the method comprising the steps of detecting occurrence of an increase in output signal level from the sensor coil and effecting closure of the switch means, and detecting occurrence of a decrease in output signal level from the sensor coil and effecting opening of the switch means, wherein the switch means is opened for a predetermined period and closure of the switch means is subsequently effected unless within the predetermined period a further decrease in output signal level, consecutive with the previous decrease in output signal level, is detected.

The increase in output signal level from the sensor coil may result from placement of the cooking utensil on the cook top.

The further decrease in output signal level may result from transition of the material comprising the heating element from a substantially non-ferromagnetic state to a ferromagnetic state at the predetermined temperature. The predetermined temperature may be the Curie temperature of the material comprising the heating element.

The switch means may comprise a relay.

Effecting closure and opening respectively of the switch means may result in energising and de-energising respectively of the heating element, with the proviso that energising may be inhibited by a further independent switch means, such as a temperature limiter or an energy regulating or power controlling device.

The predetermined period may be of the order of 10 seconds.

The sensor coil suitably comprises an inductive sensor coil, which may be wound without a core.

The sensor coil may be located beneath the heating element in the heater and may be embedded in thermal insulation material which may comprise microporous thermal insulation material provided in a support dish for the heater.

The sensor coil may comprise anodised aluminium or anodised aluminium alloy.

The heating element may comprise an iron-chromium-aluminium alloy.

The cook top may comprise glass-ceramic.

The method of the invention may be suitably implemented by means of microprocessor-based circuitry.

For a better understanding of the present invention and to show more clearly how it may be carried into effect, reference will now be made, by way of example, to the accompanying drawings in which:

DESCRIPTION OF PREFERRED EMBODIMENT

Figure 1:
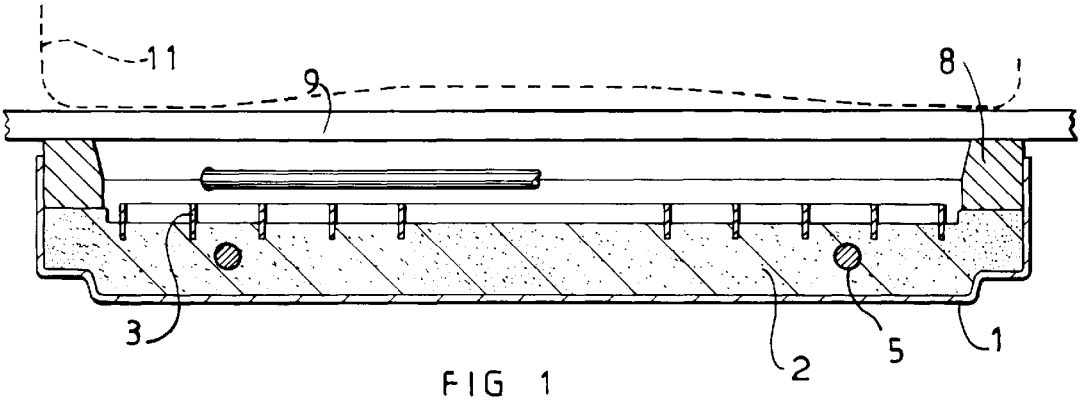
FIG. 1 is a cross-sectional view of an electric heater for use with the method of the present invention, the heater being located under a glass-ceramic cook top and incorporating a sensor coil.
Figure 2:
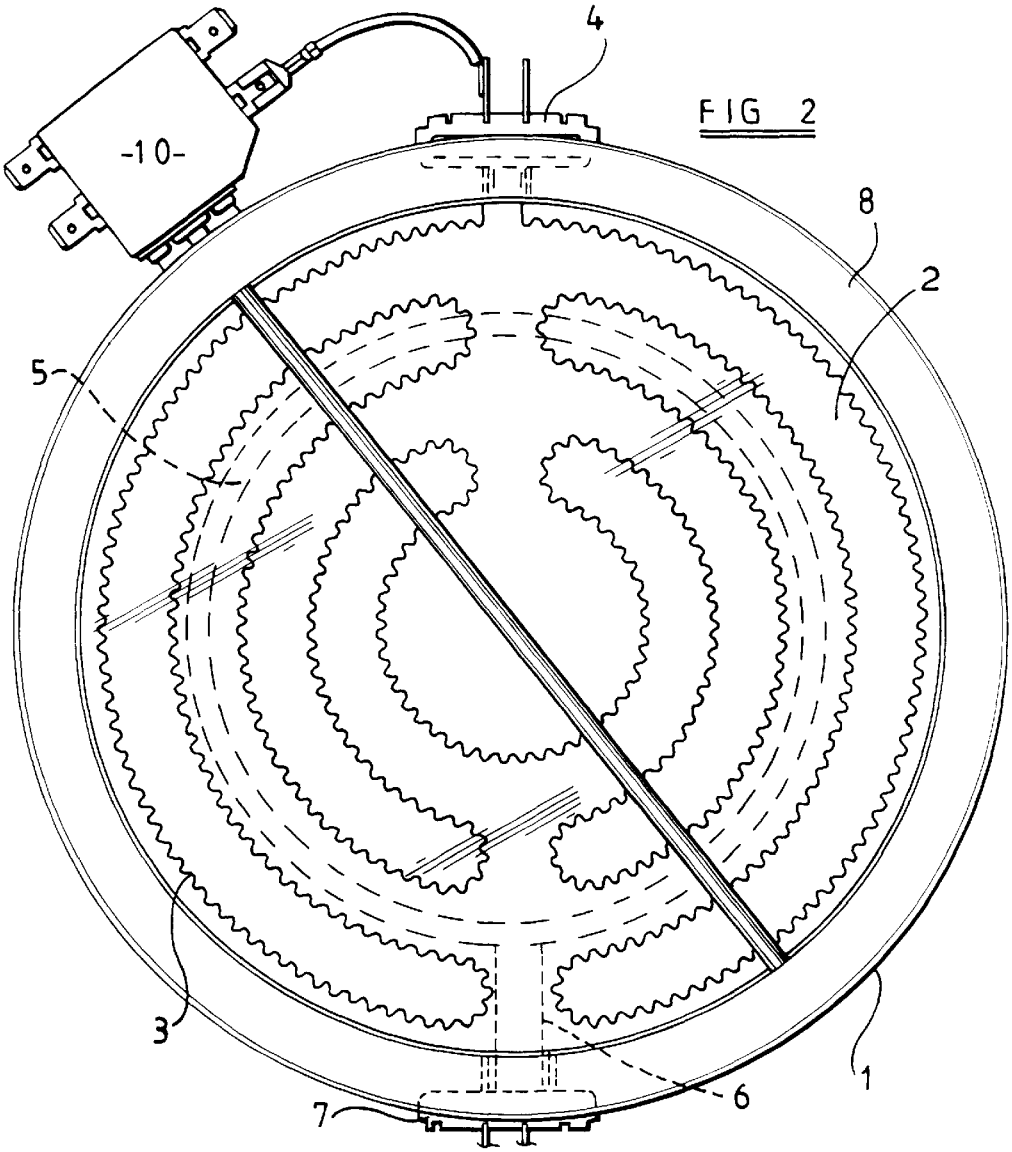
FIG. 2 is a plan view of the heater of FIG. 1.

Referring to FIGS. 1 and 2, a radiant electric heater comprises a metal support dish 1 having therein a layer 2 of compacted microporous thermal and electrical insulation material. Such insulation material is well known in the art and described, for example, in United Kingdom Patent Specification No. 1 580 909. A typical composition is:

Pyrogenic silica 49 to 97% by weight

Ceramic fibre reinforcement 0.5 to 20% by weight

Opacifier (e.g. titanium dioxide) 2 to 50% by weight

Alumina up to 12% by weight

Supported on the insulation layer 2 is an electrical heating element 3 of well known form and which, for example, could be of corrugated ribbon form arranged on edge and secured by partial embedding in the insulation layer 2. Alternatively, the heating element 3 could be of well known coiled wire form. The heating element 3 comprises a material, such as iron-chromium-aluminium alloy, which is ferromagnetic below and substantially non-ferromagnetic above a predetermined temperature within the operating temperature range of the heater. Such predetermined temperature is known as the Curie temperature.

A terminal block 4 is provided on the edge of the dish 1 for electrically connecting the heating element 3 to an electrical power source.

Figure 3:
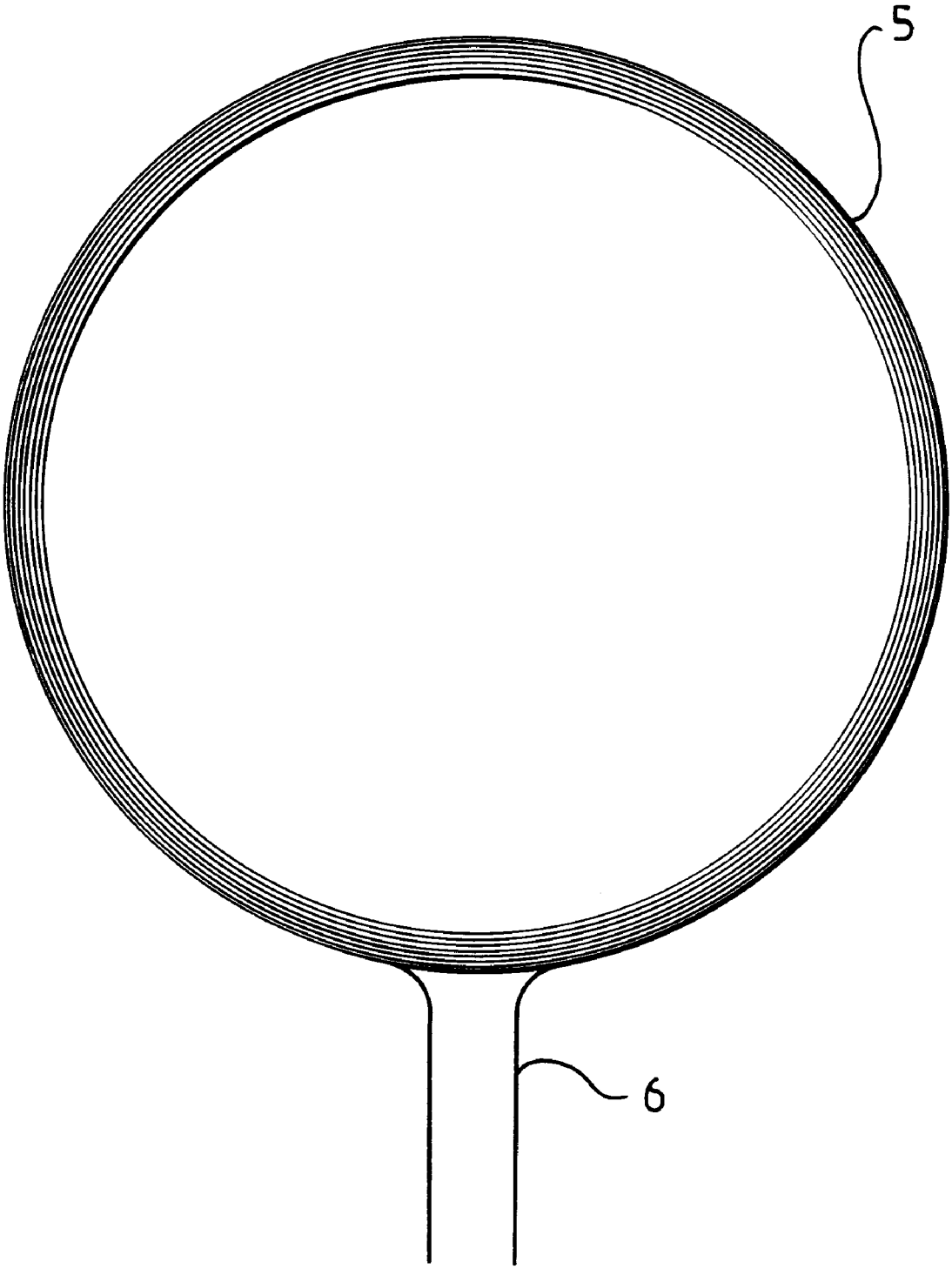
FIG. 3 is a plan view of the sensor coil in the heater of FIGS. 1 and 2.

Embedded in the insulation layer 2 beneath the heating element 3, and within magnetic influence of the heating element 3, is an inductive sensor coil 5 as shown in detail in FIG. 3. The sensor coil 5 comprises a number of turns of wire, such as anodised aluminium wire, forming a loop without a core or former. By way of example, the coil 5 may comprise about 20 turns of anodised wire, the wire having a diameter of about 0.5 mm. The coil could have a diameter of, for example, about 100 mm. The tails 6 of the coil are electrically connected to a terminal block 7 on the edge of the dish 1 and by means of which the sensor coil is arranged to be connected to electronic processing circuitry which is described hereinafter.

A peripheral wall 8 of thermal insulation material, of well known form, is provided in the heater and the heater is supported beneath a glass-ceramic cook top 9 with the upper surface of the peripheral wall 8 in contact with the underside of the cook top 9.

A well known form of thermal limiter 10 is provided extending across the heater.

When a metal cooking utensil 11 is placed on the cook top 9, a change in inductance occurs in the sensor coil 5 and a resulting change in an output signal level from the coil 5 is required to be processed to effect automatic switching on of the heating element 3. When the cooking utensil 11 is removed from the cook top 9, a resulting change in the opposite sense in the output signal level from the coil 5 is required to be processed to effect automatic switching off of the heating element 3.

A problem arises in that the heating element 3 also magnetically influences the sensor coil 5 and, as previously stated, the heating element 3 is of a material which has a Curie temperature within the operating temperature range of the heater. This means that below the Curie temperature the heating element is ferromagnetic and magnetically influences the sensor coil 5, while above the Curie temperature the heating element is substantially non-ferromagnetic. The transition from ferromagnetic to non-ferromagnetic and vice-versa occurs rapidly and produces a change in inductance in the sensor coil 5 of similar amplitude to and at a similar rate as that resulting from removal or placement of a cooking utensil 11 from or onto the cook top 9. Such transitions could cause confusion to processing circuitry and result in erroneous switching on or off of the heating element 3.

This problem is overcome by the method of the present invention, as follows.

Figure 4:
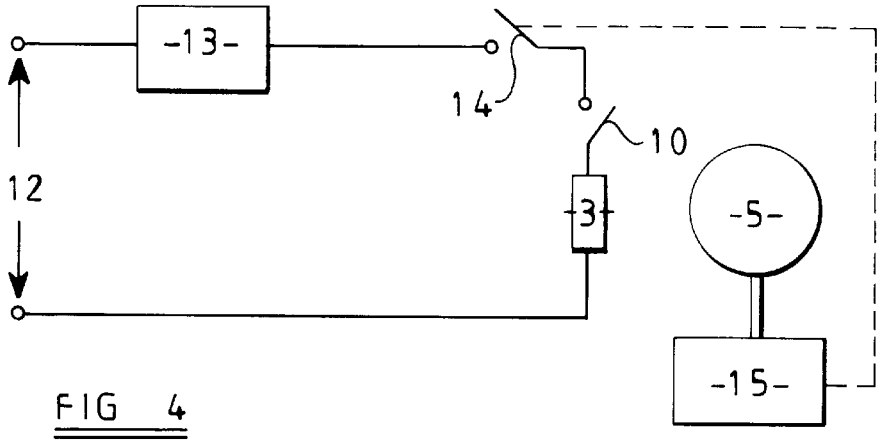
FIG. 4 is a circuit diagram showing the heater of FIGS. 1 and 2 connected for operation according to the method of the present invention.

Referring to FIG. 4, the heating element 3 of the heater is connected to a power source 12 through the temperature limiter 10, an energy regulator 13 and a relay 14 which is operated by signal processing circuitry 15 that receives an electrical signal output from the sensor coil 5 in the heater.

Figure 5:
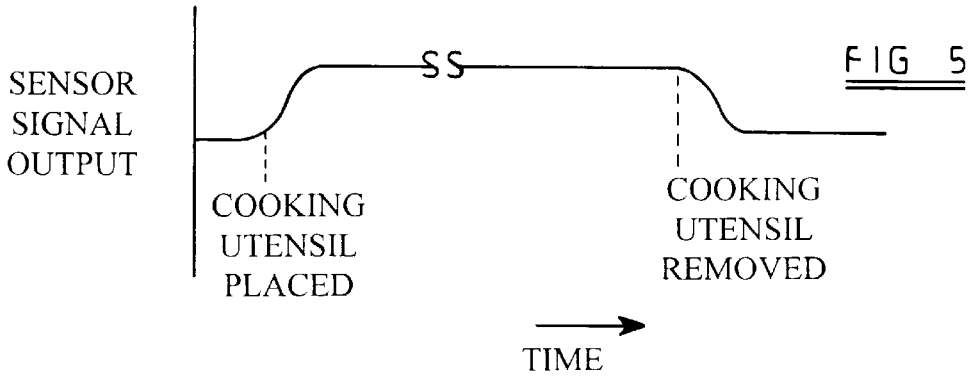
FIGS. 5 to 12 illustrate signal output transitions from a sensor coil in the heater of FIGS. 1 and 2 and operation of processing circuitry according to the method of the present invention.

A typical variation in electrical signal output from the sensor coil 5 as a result of a cooking utensil 11 being placed on and removed from the glass-ceramic cook top 9 is shown in FIG. 5.

Figure 6:
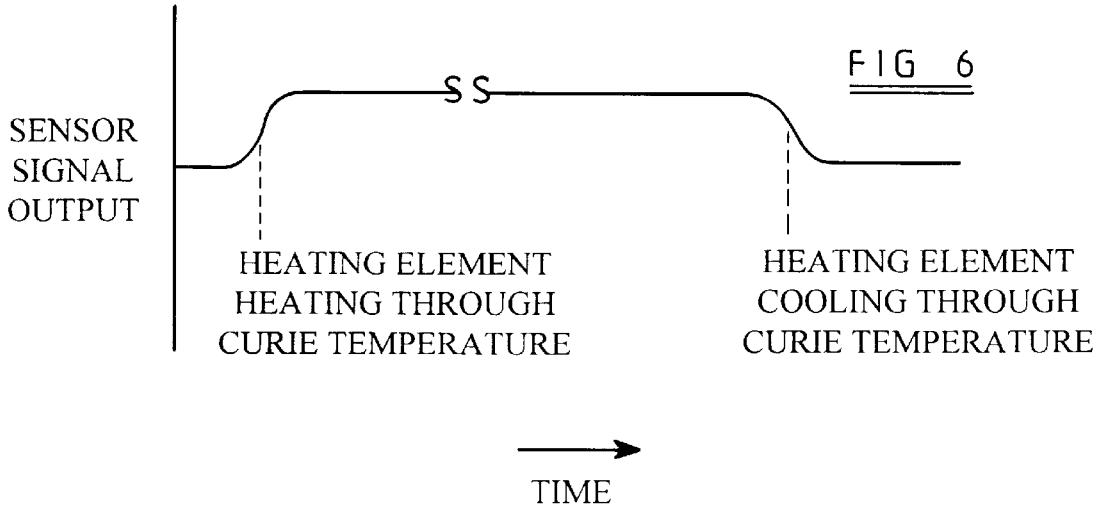

A typical variation in electrical signal output from the sensor coil 5 as a result of the heating element 3 heating up through its Curie temperature and then cooling down again is shown in FIG. 6.

Figure 7:
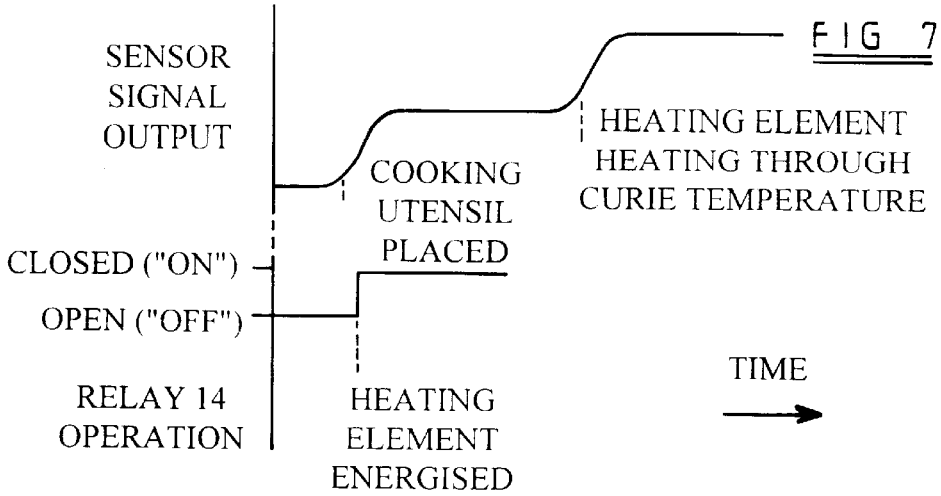

A typical sequence of events is illustrated in FIG. 7, with a cooking utensil 11 being placed on the cook top and resulting in a first positive signal output transition from the sensor coil 5 which is processed to cause the relay 14 (FIG. 4) to close and the heating element 3 to be energised. As the heating element 3 passes through its Curie temperature, the element changes from a ferromagnetic to a non-ferromagnetic state. This results in a second positive signal output transition from the sensor coil 5. Such second positive signal output transition is not a problem because the heating element 3 is already in an energised state and the processing circuitry would effectively interpret the second output transition as requiring the element to be energised.

However problems arise when a negative signal output transition occurs from the sensor coil 5. Such a negative signal output transition occurs when the cooking utensil is removed from the cook top, but also occurs when the heating element cools below its Curie temperature on being de-energised as a result of the energy regulator 13 turning off or the temperature limiter 10 opening. As seen from FIGS. 5 and 6, the processing circuitry 15 would not normally be able to distinguish between a cooking utensil being removed or the heating element turning off.

Consequently the processing circuitry 15 (FIG. 4) might operate to open the relay 14 even when the cooking utensil 11 has not been removed but remains in place on the cook top.

The method of the invention relies on the fact that following interruption of power to the heating element, for whatever reason, the heating element will cool and pass through its Curie temperature within a certain time period. This time period is generally shorter than the minimum time period for which the energy regulator 13 or the temperature limiter 10 is in an "open" state and typically of the order of 10 seconds.

Figure 8:
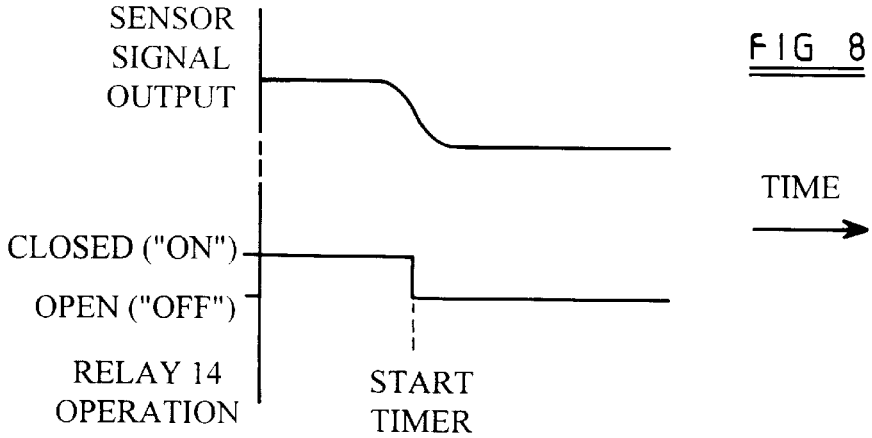

Referring now to FIG. 8, when a negative signal output transition from the sensor coil 5 is detected, relay 14 is caused to open. If this negative transition was caused by the heater cooling down then the heating element 3 must already be in a de-energised state, effected by the energy regulator 13 or the temperature limiter 10. Hence opening of the relay 14 is of no consequence to the cooking process. If the negative transition was caused by a cooking utensil 11 being removed from the cook top, then opening of the relay 14 to de-energise the heating element 3 is required in any event. In this latter situation, a further negative transition, resulting from the heating element cooling and passing though its Curie temperature, will subsequently occur shortly after the relay 14 has opened.

As illustrated in FIG. 8, it is arranged for a timer in the processing circuitry to start when the relay 14 opens. If a further negative signal output transition, consecutive with the previous negative transition, is detected from the sensor coil before this timer "times out" (i.e. reaches the end of a predetermined set period of operation), which in practice may be of the order of a period of 10 seconds, then the processing circuitry knows that the previous negative transition must have occurred as a result of a cooking utensil being removed. In this case relay 14 is caused to remain open (until such time that a positive signal output transition is detected as a result of placement of a cooking utensil, or the system is reset or disabled).

Figure 9:
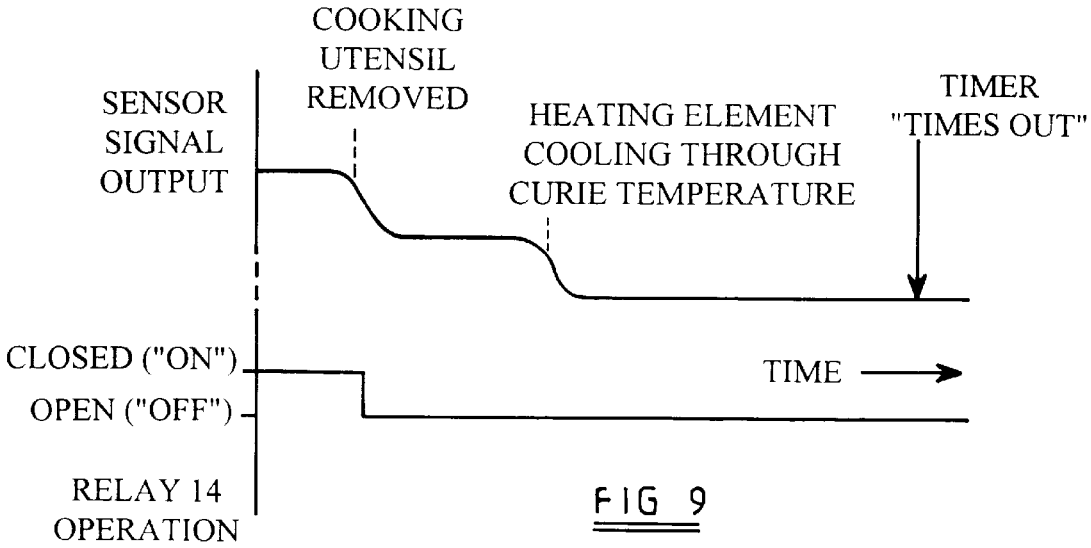
Figure 10:
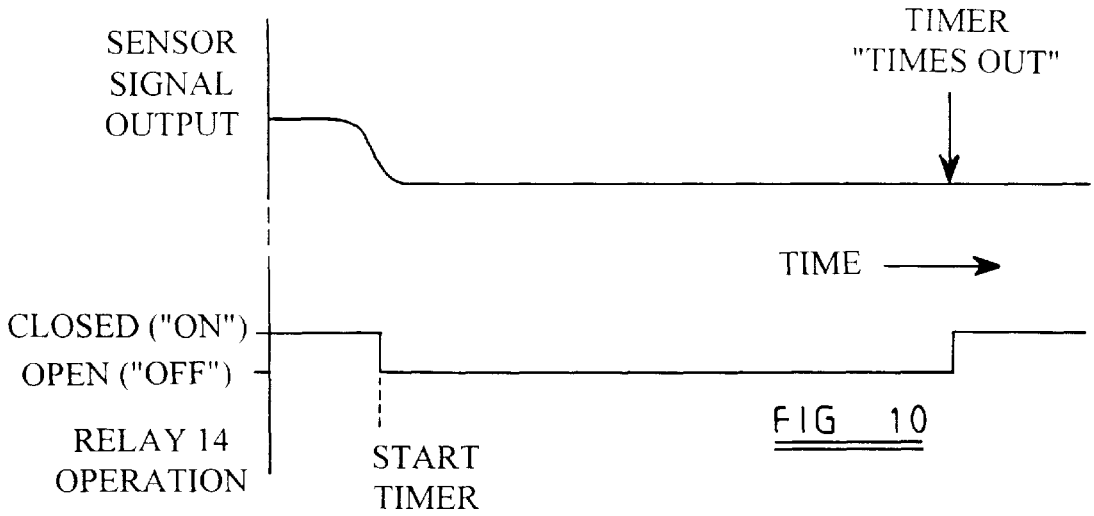

If no such further negative signal output transition is detected before the timer times out, the processing circuitry then knows that the previous negative transition must have been caused by the heating element cooling down following de-energisation as a result of opening of the limiter 10 or the energy regulator 13. In this case, relay 14 is caused to close to enable re-energisation of the heating element to occur when the limiter 10 or energy regulator 13 subsequently re-closes. These events are illustrated in FIGS. 9 and 10.

Figure 11:
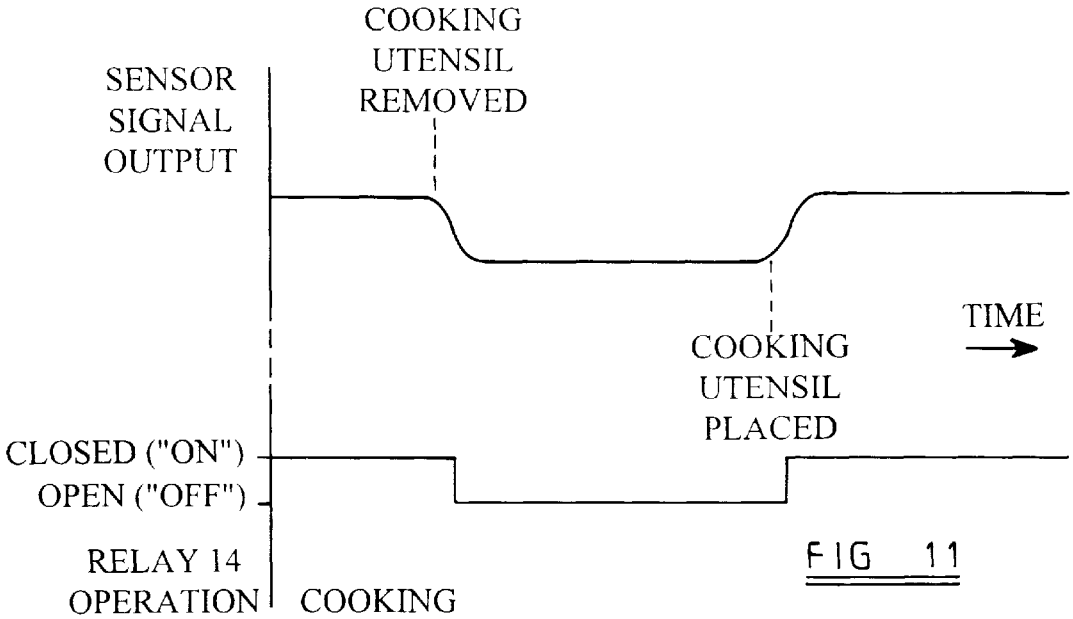
Figure 12:
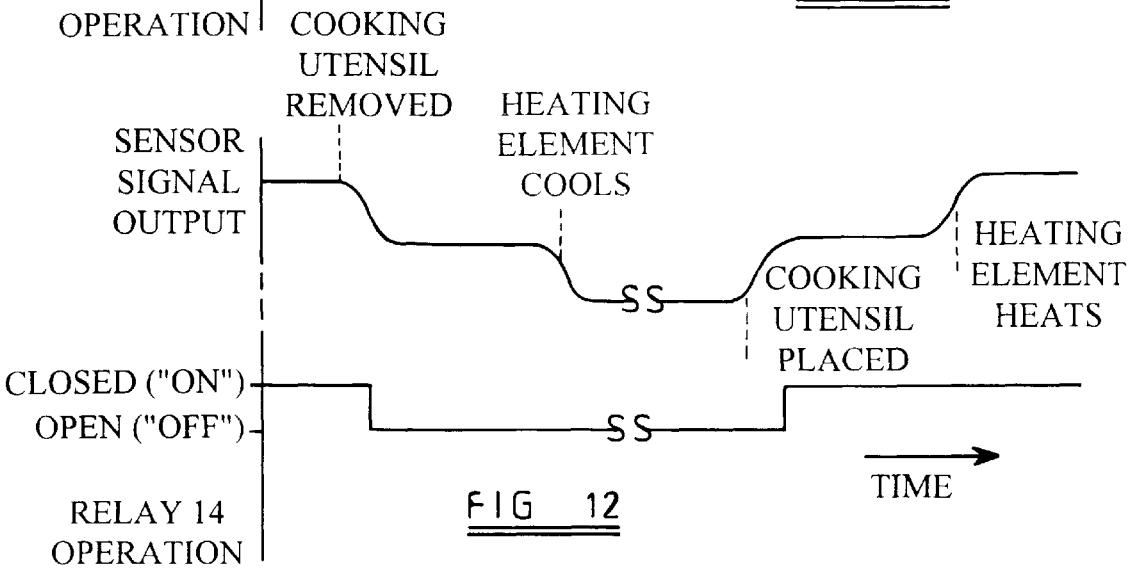

A positive signal output transition following either a single or a double negative signal output transition will always cause relay 14 to be closed, as illustrated in FIGS. 11 and 12. The sequence of events in FIG. 11 is caused by a cooking utensil being removed from the cook top and then quickly replaced. In this case the relay 14 is required to close when a positive signal output transition is detected (i.e. a cooking utensil is replaced on the cook top). The sequence of events illustrated in FIG. 12 corresponds to the removal of a cooking utensil (first negative signal output transition) followed by the subsequent cooling of the heating element through its Curie temperature (second negative signal output transition) and further followed by replacement of the cooking utensil (first positive signal output transition). At this point the relay 14 is caused to close, thus re-energising the heating element, and this leads to a second positive signal output transition as the heating element heats up though its Curie temperature.

The processing circuitry 15 is conveniently microprocessor based and, as a result, may be additionally applied to fulfill other control functions associated with the heater.

I claim:

1. A method of processing an electrical signal output from a sensor coil located in an electric heater for use under a cook top in a cooking appliance and operating a switch means to switch on and off a heating element in the heater in accordance with placement and removal of a cooking utensil on and from the cook top respectively, the sensor coil being arranged in the heater within magnetic influence of the electrical heating element, the heating element comprising a material which is ferromagnetic below and substantially non-ferromagnetic above a predetermined temperature within an operating temperature range of the heater, the method comprising the steps of detecting occurrence of an increase in output signal level from the sensor coil and effecting closure of the switch means, and detecting occurrence of a decrease in output signal level from the sensor coil and effecting opening of the switch means, wherein the switch means is opened for a predetermined period and closure of the switch means is subsequently effected unless within the predetermined period a further decrease in output signal level, consecutive with the previous decrease in output signal level, is detected.

2. A method according to claim 1, wherein the increase in output signal level from the sensor coil results from placement of the cooking utensil on the cook top.

3. A method according to claim 1, wherein the further decrease in output signal level results from transition of the material comprising the heating element from a substantially non-ferromagnetic state to a ferromagnetic state at the predetermined temperature.

4. A method according to claim 3, wherein the predetermined temperature is the Curie temperature of the material comprising the heating element.

5. A method according to claim 1, wherein the switch means comprises a relay.

6. A method according to claim 1, wherein effecting closure and opening respectively of the switch means results in energising and de-energising respectively of the heating element, with the proviso that energising may be inhibited by a further independent switch means.

7. A method according to claim 6, wherein the further independent switch means is selected from the group consisting of a temperature limiter, an energy regulating device and a power controlling device.

8. A method according to claim 1, wherein the predetermined period is of the order of 10 seconds.

9. A method according to claim 1, wherein the sensor coil comprises an inductive sensor coil.

10. A method according to claim 9, wherein the coil is wound without a core.

11. A method according to claim 1, wherein the sensor coil is located beneath the heating element in the heater.

12. A method according to claim 11, wherein the sensor coil is embedded in thermal insulation material.

13. A method according to claim 12, wherein the insulation material comprises microporous thermal insulation material provided in a support dish for the heater.

14. A method according to claim 1, wherein the material of the sensor coil is selected from the group consisting of anodised aluminium and anodised aluminium alloy.

15. A method according to claim 1, wherein the heating element comprises an iron-chromium-aluminium alloy.

16. A method according to claim 1, wherein the cook top comprises glass-ceramic.

17. A method according to claim 1, wherein the method is implemented by means of microprocessor-based circuitry.

* * * * *